US011614712B2

(12) United States Patent
Morales Ramirez

(10) Patent No.: US 11,614,712 B2
(45) Date of Patent: Mar. 28, 2023

(54) TIMEPIECE DISPLAY DEVICE

(71) Applicant: Cesar Guadalupe Morales Ramirez, Metepec (MX)

(72) Inventor: Cesar Guadalupe Morales Ramirez, Metepec (MX)

( * ) Notice: Subject to any disclaimer, the term of this patent is extended or adjusted under 35 U.S.C. 154(b) by 324 days.

(21) Appl. No.: 17/016,308

(22) Filed: Sep. 9, 2020

(65) Prior Publication Data

US 2022/0075319 A1 Mar. 10, 2022

(51) Int. Cl.
*G04B 19/04* (2006.01)
*G04B 37/00* (2006.01)

(52) U.S. Cl.
CPC ..... *G04B 19/04* (2013.01); *G04B 37/0091* (2013.01)

(58) Field of Classification Search
CPC ..... G04B 19/046; G04B 19/06; G04B 19/04; G04B 37/0091
See application file for complete search history.

(56) References Cited

U.S. PATENT DOCUMENTS 5,272,681 A * 12/1993 Lee ..... G04B 45/0061 368/76
5,805,531 A * 9/1998 Schafer ..... G04B 45/046 368/76
5,848,029 A * 12/1998 Chang ..... G04B 45/04 368/45
5,850,373 A * 12/1998 Lee ..... G04B 45/0007 368/76
6,388,953 B1 * 5/2002 Wu ..... G04B 45/0038 368/76
6,416,217 B1 * 7/2002 Von Braunhut ..... G04B 47/044 368/278
6,438,072 B1 * 8/2002 Tsai ..... A01K 63/003 368/228
7,050,359 B2 * 5/2006 Dagan ..... G09F 1/10 368/228
2018/0143593 A1 * 5/2018 Morris ..... G04C 17/00

* cited by examiner

*Primary Examiner* — Sean Kayes

(57) ABSTRACT

A timepiece display device comprises a timepiece body, a support plate, a timepiece driving module, a rotating optical disc, a magnetic element, a top plate, and a rotating shaft of the timepiece driving module passes through the support plate and connects to the center of the rotating optical disc to drive the rotating optical disc to rotate; a display comprises an annular base mounted in the upper chamber of the timepiece body, a dial mounted inside the annular base, an indicator element placed on the dial and corresponding to the time identifier on the dial, and a crystal covering the upper end of the annular base. The indicator element and the magnetic element are positioned by the magnetic attraction of the magnetic element, and the indicator element moves synchronously with the magnetic element to indicate the time.

9 Claims, 4 Drawing Sheets

TIMEPIECE DISPLAY DEVICE

BACKGROUND OF INVENTION

1. Field of the Invention

The present invention relates to the technical field of timepiece products, in particular to a timepiece display device.

2. Description of Related Art

Clocks and watches are a kind of timing device, and also a precise instrument for measuring and indicating time.

The timepiece display device in the prior art generally comprises a timepiece driving module, a power gear mounted on a driving shaft of the timepiece driving module, a transmission gear set composed of a plurality of gears, and a second hand, a minute hand and a hour hand mounted on the transmission gear set and driven to rotate by the transmission gear set. When in operation, after the second hand is driven to rotate for one circle, the minute hand moves one division, and after the minute hand rotates for one circle, the hour hand moves one division.

However, the adoption of a transmission gear set, composed of multiple gears, as a structure to drive the second hand, the minute hand, and the hour hand to rotate is more complicated, and the assembly is also complicated.

In view of this, the present inventor proposes the following technical solutions.

SUMMARY OF THE INVENTION

The purpose of the invention is to overcome the shortcomings of the prior art and provide a timepiece display device.

In order to solve the above technical problems, the present utility model adopts the following technical solutions:

A timepiece display device, comprising:

a timepiece mechanism, which includes a timepiece body, a support plate mounted in the timepiece body to divide the inner cavity of the timepiece body into an upper chamber and a lower chamber, a timepiece driving module mounted in the lower chamber of the timepiece body, a rotating optical disc mounted on the upper end of the support plate, a magnetic element fixed to the rotating optical disc, and a top plate mounted on the bottom of the upper chamber of the timepiece body, and a rotating shaft 131 of the timepiece driving module passes through the support plate and connects to the center of the rotating optical disc to drive the rotating optical disc to rotate;

a display, which includes an annular base mounted in the upper chamber of the timepiece body, a dial mounted inside the annular base, an indicator element placed on the dial and corresponding to the time identifier on the dial, and a crystal covering the upper end of the annular base; the indicator element and the magnetic element are positioned by the magnetic attraction of the magnetic element, and the indicator element moves synchronously with the magnetic element to indicate the time.

More particularly, wherein the middle of the inner cavity of the timepiece body is formed with a partition flange, and the upper end of the support plate is fixed to the lower end surface of the partition flange; the lower end of the top plate is fixed to the upper end surface of the partition flange, and a movable space is formed between the support plate and the top plate, and the movable space is a sealed space; the rotating optical disc and the magnetic element are placed in the movable space.

More particularly, wherein the magnetic element is a magnet.

More particularly, wherein a back plate is installed at the lower end of the timepiece body, said back plate is used to encapsulate the timepiece driving module in the timepiece body.

More particularly, wherein a bottom plate is fixed at the bottom of the annular base, a sealed space is formed between the bottom plate, the annular base, and the crystal, and the dial is placed in the sealed space.

More particularly, wherein the outer side of the annular base is provided with an external thread. The inner wall of the upper chamber of the timepiece body is provided with an inner thread; said annular base is fixed through the threading of the outer thread with the internal thread of the inner wall of the upper chamber of the timepiece body, so that the display is fixed in the upper chamber of the timepiece body.

More particularly, wherein the annular base is fixedly assembled with the timepiece body by screws, so that the display is fixed in the upper chamber of the timepiece body.

More particularly, wherein an O-shaped sealing ring is sleeved around the annular base, and the O-shaped sealing ring is pressed against the inner wall of the upper chamber of the timepiece body.

More particularly, wherein the time identifier on the dial includes hour characters, or the time identifier on the dial includes an hour identifier.

Compared with the prior art, the present invention has the following benefits.

The present invention adopts a rotating optical disc and a magnetic element to replace the transmission gear set of the prior art, and uses an indicator element that can be magnetically positioned by the attraction of the indicator element to replace an indicator. When the rotating optical disc rotates, it will drive the magnetic element to move in a circle, which will also drive the indicator element on the dial to move in a circle to achieve the purpose of indicating time. It is different from the way in which the existing timepiece display device displays the time, and the adoption of such a structure can simplify the timepiece display device structure of the prior art, reduce the number of parts, improve the assembly efficiency and make it competitive in the market.

DETAILED DESCRIPTION OF THE INVENTION

The present invention is further described in combination with specific embodiments and drawings in the following.

As shown in FIGS. 1-6, it is a timepiece display device, which comprises a timepiece mechanism 1 and a display 2 mounted on the timepiece mechanism 1. The display 2 is a sealed structure.

Figure 1:
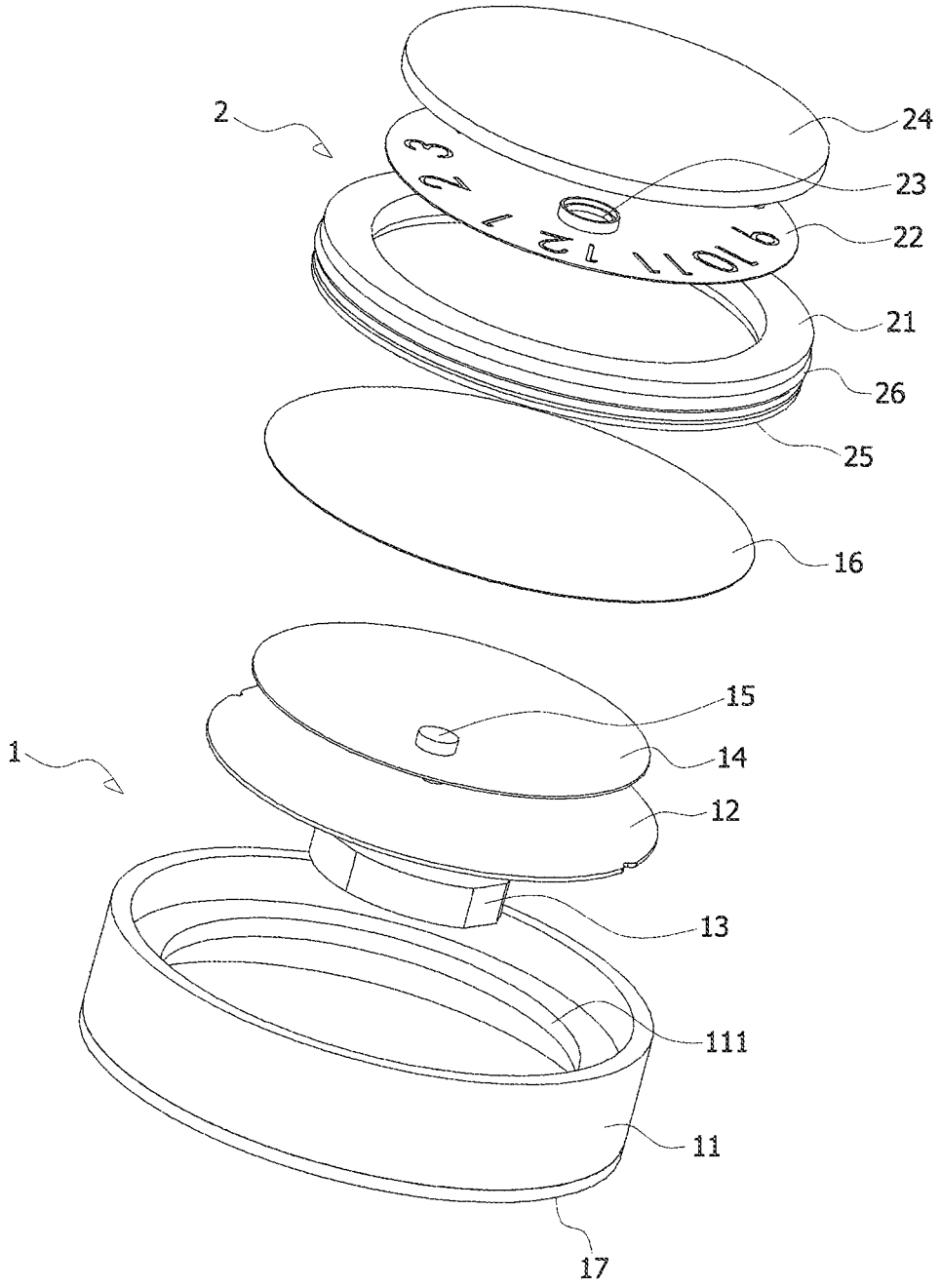
FIG. 1 is a three-dimensional exploded view of the present invention.
Figure 2:
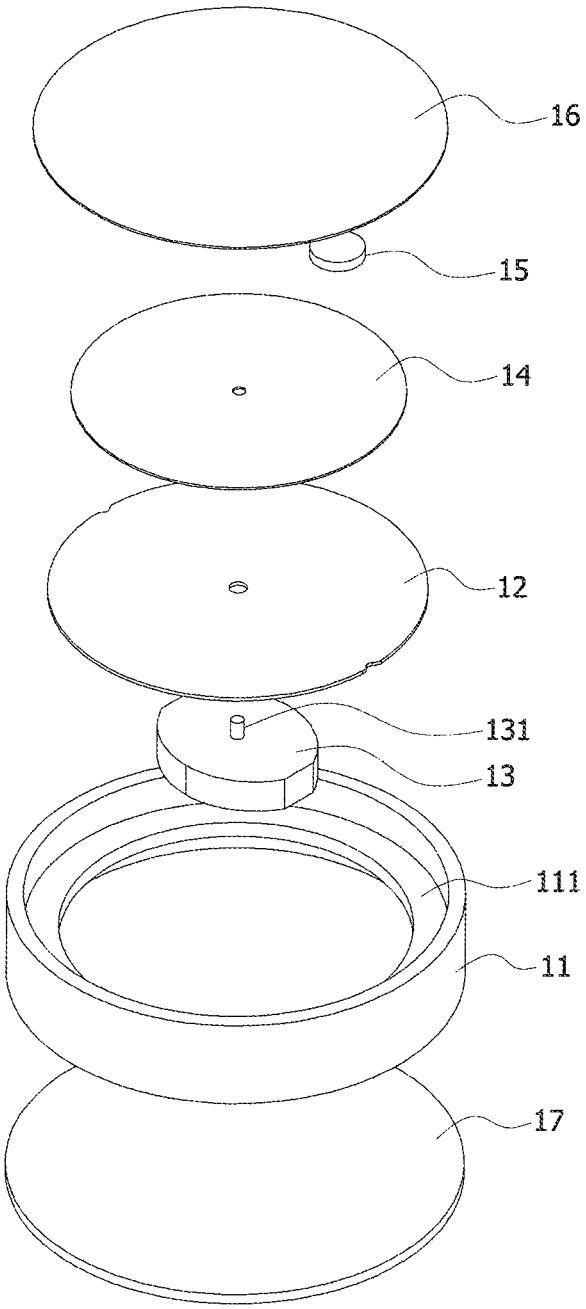
FIG. 2 is a three-dimensional exploded view of the timepiece mechanism of the present invention.
Figure 3:
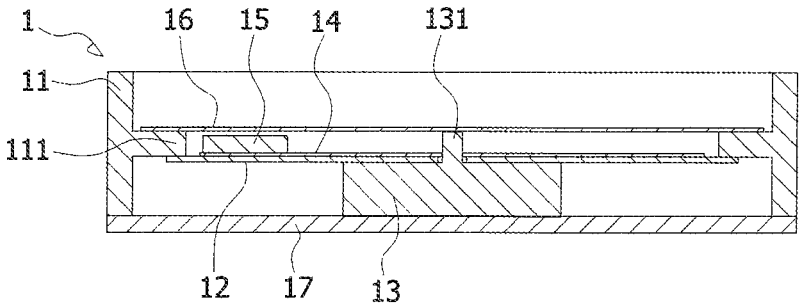
FIG. 3 is a sectional view of the timepiece mechanism of the present invention.
Figure 4:
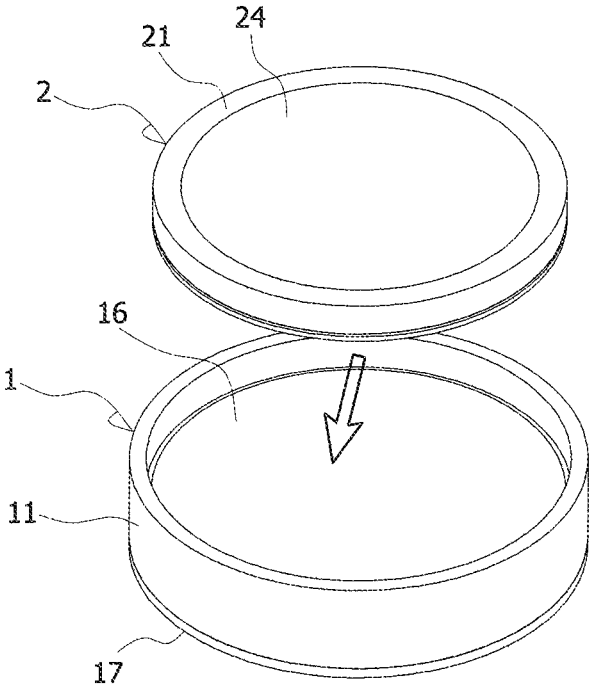
FIG. 4 is an assembly drawing of the present invention.
Figure 5:
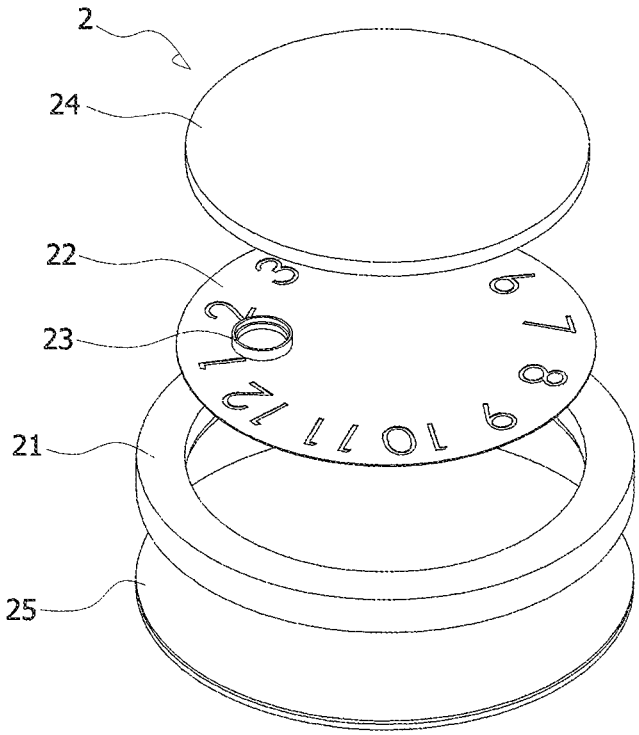
FIG. 5 is a three-dimensional exploded view of the display in the present invention.

With reference to FIGS. 1, 2, and 3, the timepiece mechanism 1 comprises a timepiece body 11, a support plate 12 mounted in the timepiece body 11 to divide the inner cavity of the timepiece body 11 into an upper chamber and a lower chamber, a timepiece driving module 13 mounted in the lower chamber of the timepiece body 11, a rotating optical disc 14 mounted on the upper end of the support plate 12, a magnetic element 15 fixed to the rotating optical disc 14, and a top plate 16 mounted on the bottom of the upper chamber of the timepiece body 11, and a rotating shaft 131 of the timepiece driving module 13 passes through the support plate 12 and connects to the center of the rotating optical disc 14 to drive the rotating optical disc 14 to rotate; wherein the middle of the inner cavity of the timepiece body 11 is formed with a partition flange 111, and the upper end of the support plate 12 is fixed to the lower end surface of the partition flange 111; the lower end of the top plate 16 is fixed to the upper end surface of the partition flange 111, and a movable space is formed between the support plate 12 and the top plate 16, and the movable space is a sealed space; the rotating optical disc 14 and the magnetic element 15 are placed in the movable space. When the timepiece driving module 13 is in operation, the rotating shaft 131 rotates and drives the rotating optical disc 14 to rotate, thus making the magnetic element 15 on the rotating optical disc 14 rotate in a circle.

The magnetic element 15 is a magnet, preferably, a permanent magnet.

With reference to FIG. 3, a back plate 17 is also installed at the lower end of the timepiece body 11. The back plate 17 is used to encapsulate the timepiece driving module 13 in the timepiece body 11, so that the timepiece driving module 13 is encapsulated in the timepiece body 11.

With reference to FIGS. 2, 4, 5, and 6, the display 2 comprises an annular base 21 mounted in the upper chamber of the timepiece body 11, a dial 22 mounted inside the annular base 21, an indicator element 23 placed on the dial 22 and corresponding to the time identifier on the dial 22, and a crystal 24 covering the upper end of the annular base 21. The indicator element 23 and the magnetic element 15 are positioned by the magnetic attraction of the magnetic element 15, and the indicator element 23 moves synchronously with the magnetic element 15 to indicate the time. That is to say, the present invention adopts a rotating optical disc 14 and a magnetic element 15 to replace the transmission gear set of the prior art, and uses an indicator element 23 capable of being magnetically positioned by the attraction of the indicator element 23 to replace an indicator. When the rotating optical disc 14 rotates, it will drive the magnetic element 15 to move in a circle, which will also drive the indicator element 23 on the dial 22 to move in a circle to achieve the purpose of indicating time. It is different from the way in which the existing timepiece display device displays the time, and the adoption of such a structure can simplify the timepiece display device structure of the prior art, reduce the number of parts, improve the assembly efficiency and make it competitive in the market.

The indicator element 23 is made of a material that can be attracted by the magnetic element 15, such as an iron material or a magnet.

The indicator element 23 can be an indicator shape or a sheet shape or a block shape.

The interval between the magnetic element 15 and the indicator element 23 is small, so as to improve the magnetic attraction tween the two.

Figure 6:
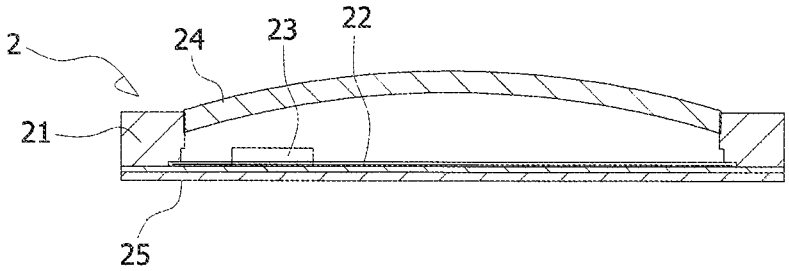
FIG. 6 is a sectional view of the display in the present invention.

With reference to FIG. 6, a bottom plate 25 is fixed at the bottom of the annular base 21. A sealed space is formed between the bottom plate 25, the annular base 21, and the crystal 24, and the dial 22 is placed in the sealed space.

The outer side of the annular base 21 is provided with an external thread (not shown). The inner wall of the upper chamber of the timepiece body 11 is provided with an inner thread (not shown). The annular base 21 is fixed through the threading of the outer thread with the internal thread of the inner wall of the upper chamber of the timepiece body 11, so that the display 2 is fixed in the upper chamber of the timepiece body 11. Alternatively, the annular base 21 is fixedly assembled with the timepiece body 11 by screws (not shown), so that the display 2 is fixed in the upper chamber of the timepiece body 11.

With reference to FIG. 1, an O-shaped sealing ring 26 is sleeved around the annular base 21, and the O-shaped sealing ring 26 is pressed against the inner wall of the upper chamber of the timepiece body 11 to ensure the sealing tightness of the display 2 and the timepiece mechanism 1 after assembly.

The time identifier on the dial 22 includes hour characters, or includes an hour identifier. In other words, when the indicator element 23 points to the position of hour character or hour identifier, the time displayed is the hour, such as 12 o'clock. As the indicator element 23 points to the position between the hour character and the hour identifier, minute can be identified according to the position in the interval. For example, as the indicator element 23 points to the middle between the adjacent hour characters 12 and 1 or between the adjacent hour identifiers 12 and 1, the time is 12:30.

In summary, the present invention adopts a rotating optical disc 14 and a magnetic element 15 to replace the transmission gear set of the prior art, and uses an indicator element 23 that can be magnetically positioned by the attraction of the indicator element 23 to replace an indicator. When the rotating optical disc 14 rotates, it will drive the magnetic element 15 to move in a circle, which will also drive the indicator element 23 on the dial 22 to move in a circle to achieve the purpose of indicating time. It is different from the way in which the existing timepiece display device displays the time, and the adoption of such a structure can simplify the timepiece display device structure of the prior art, reduce the number of parts, improve the assembly efficiency and make it competitive in the market.

I claim:

1. A timepiece display device, comprising:

a timepiece mechanism (1), which includes a timepiece body (11), a support plate (12) mounted in the timepiece body (11) to divide an inner cavity of the timepiece body (11) into an upper chamber and a lower chamber, a timepiece driving module (13) mounted in a lower chamber of the timepiece body (11), a rotating optical disc (14) mounted on an upper end of the support plate (12), a magnetic element (15) fixed to the rotating optical disc (14), and atop plate (16) mounted on a bottom of the upper chamber of the timepiece body (11), and a rotating shaft 131 of the timepiece driving module (13) passes through the support plate (12) and connects to the center of the rotating optical disc (14) to drive the rotating optical disc (14) to rotate;

a display (2), which includes an annular base (21) mounted in the upper chamber of the timepiece body (11), a dial (22) mounted inside the annular base (21), an indicator element (23) placed on the dial (22) and corresponding to the time identifier on the dial (22), and a crystal (24) covering an upper end of the annular base (21); the indicator element (23) and the magnetic element (15) are positioned by the magnetic attraction of the magnetic element (15), and the indicator element (23) moves synchronously with the magnetic element (15) to indicate the time.

2. The timepiece display device defined in claim 1, wherein the middle of the inner cavity of the timepiece body (11) is formed with a partition flange (111), and the upper end of the support plate (12) is fixed to a lower end surface of the partition flange (111); a lower end of the top plate (16) is fixed to an upper end surface of the partition flange (111), and a movable space is formed between the support plate (12) and the top plate (16), and the movable space is a sealed space; the rotating optical disc (14) and the magnetic element (15) are placed in the movable space.

3. The timepiece display device defined in claim 1, wherein the magnetic element (15) is a magnet.

4. The timepiece display device defined in claim 1, wherein a back plate (17) is installed at a lower end of the timepiece body (11), said back plate (17) is used to encapsulate the timepiece driving module (13) in the timepiece body (11).

5. The timepiece display device defined in claim 1, wherein a bottom plate (25) is fixed at a bottom of the annular base (21), a sealed space is formed between the bottom plate (25), the annular base (21), and the crystal (24), and the dial (22) is placed in the sealed space.

6. The timepiece display device defined in claim 1, wherein the outer side of the annular base (21) is provided with an external thread; an inner wall of the upper chamber of the timepiece body (11) is provided with an inner thread; said annular base (21) is fixed through the threading of the outer thread with the internal thread of the inner wall of the upper chamber of the timepiece body (11), so that the display (2) is fixed in the upper chamber of the timepiece body (11).

7. The timepiece display device defined in claim 1, wherein the annular base (21) is fixedly assembled with the timepiece body (11) by screws, so that the display (2) is fixed in the upper chamber of the timepiece body (11).

8. The timepiece display device defined in claim 1, wherein an O-shaped sealing ring (26) is sleeved around the annular base (21), and the O-shaped sealing ring (26) is pressed against the inner wall of the upper chamber of the timepiece body (11).

9. The timepiece display device defined in claim 1, wherein the time identifier on the dial (22) includes hour characters, or the time identifier on the dial (22) includes an hour identifier.

* * * * *